United States Patent [19]

Omori

[11] 4,329,830

[45] May 18, 1982

[54] METHOD AND APPARATUS FOR PACKAGING POWDERY OR PARTICLE-SIZE MATERIAL

[75] Inventor: Shozo Omori, Tokyo, Japan

[73] Assignee: Omori Machinery Co., Ltd., Tokyo, Japan

[21] Appl. No.: 156,874

[22] Filed: Jun. 5, 1980

[30] Foreign Application Priority Data

Jun. 22, 1979 [JP] Japan ..... 54-78111
Jun. 29, 1979 [JP] Japan ..... 54-88440[U]

[51] Int. Cl.[3] ..... B65B 1/02; B65B 1/06

[52] U.S. Cl. ..... 53/453; 53/459; 53/561

[58] Field of Search ..... 53/559, 561, 560, 453, 53/454, 456, 468, 553, 554

[56] References Cited

U.S. PATENT DOCUMENTS 2,387,747 10/1945 Cowley ..... 53/560 X
2,600,222 6/1952 Donofrio ..... 53/560 X
3,184,895 5/1965 O'Connor ..... 53/559 X
3,354,611 11/1967 Powell ..... 53/559
3,673,760 7/1972 Canamero et al. ..... 53/559 X
3,685,251 8/1972 Mahaffy et al. ..... 53/559
4,017,247 4/1977 Soukup et al. ..... 53/559 X

*Primary Examiner*—Horace M. Culver
*Attorney, Agent, or Firm*—Wenderoth, Lind & Ponack

[57] ABSTRACT

A lower film is carried continuously along a passage having a substantially horizontal first passage part and a downwardly curved second passage part. While the lower film is carried along the first passage part, a plurality of recesses are formed on the lower film by a molding device which is moved in synchronization with the advancement of the lower film. An upper film is supplied continuously in such a manner that both upper and lower films approach together in the shape of "V" in section at the second passage part and they are sealed together as they move down further along the second passage part. While the films are partially sealed at the second passage part, powdery or particle-size material is fed into the recesses in the lower film.

6 Claims, 9 Drawing Figures

METHOD AND APPARATUS FOR PACKAGING POWDERY OR PARTICLE-SIZE MATERIAL

BACKGROUND OF THE INVENTION

This invention relates to a method and apparatus for packaging powdery or particle-size material between upper and lower films.

In a known method for packaging powdery material such as powdery medicine, sugar, or the like, it has been a common procedure to supply first and second, or lower and upper, thin plain films on a pair of sealing rolls in such a manner that these films form a V-shape in section on these rolls and these films are sealingly adhered as they go down between the sealing rollers. At this time, the powdery material is fed into the narrow pocket formed by these thin films. Then, these films are completely sealed as they pass through these rollers with the powdery material packaged therebetween.

In such a method set forth above, an inner pocket space formed by the two flat films is narrow and therefore, a relatively large pocket has to be formed by two thin films in order to smoothly feed a predetermined amount of powdery material therein. Accordingly, the length and width of the package has been very large compared with the powdery material contained therein. This means that the material costs for the packaging films have been relatively high and that the containers for enclosing a bundle or a plurality of bundles of the packages and, therefore, the space for storing the containers have to be relatively large. This has resulted in the increase of the sales price of the package.

Apart from the disadvantages set forth above, the thus formed known package has another problem when it is intended to remove the packaged powdery material by tearing one sealed end thereof. Because the powdery material often attaches to the opposite inner sealing end of the package it will not come off so easily.

Accordingly, an object of the present invention is to provide an improved method and apparatus which can package a predetermined amount of powdery material in a relatively small package formed of two films, thereby reducing the manufacturing costs and sales price thereof.

Another object of the present invention is to provide a packaging method and apparatus, wherein powdery material contained in the package can be taken out easily and completely by tearing one sealed end of the package.

Still another object of the present invention is to provide a method and apparatus which can make packages for powdery material continuously without stopping the supply of films.

A further object of the present invention is to provide a method and apparatus for packaging powdery or particle-size material without waves or wrinkles in the packaging films.

SUMMARY OF THE INVENTION

According to the present invention, a first lower film is carried continuously along a passage comprising a substantially horizontal first passage part and a downwardly curved second passage part. While the lower film is carried along the first passage part, a plurality of recesses are formed therein by a molding device which is moved in synchronization with the advancement of the first film. A second upper film is supplied continuously in such a manner that both films approach each other in the shape of "V" in section at the second passage part and then are sealed together by a pair of sealing rollers as they move down further along the second passage part. When the two films are partially sealed at the second passage part, powdery or particle-size material is fed into the recesses in the lower film.

Thus, compared with the known method and apparatus in which the powdery material is packaged between two sheet films, the lower film of the present invention is formed with a plurality of recesses therein in which the powdery material is packaged. Therefore, the area of each package formed by the present invention can be much smaller that that of the known package. Also, since the powdery material is contained in the recess in the lower film, all of the powdery material can be taken out very easily by tearing one sealed end of the package and no powdery material will remain at the opposite end thereof as experienced in the known package.

In the process for forming the recesses in the lower film, since the mold advances in synchronization with the advancement of the lower film, the recesses can be formed successively without stopping the continuous movement of the lower film.

Other objects and features of the present invention will become apparent from the following detailed description of a preferred embodiment thereof when taken in conjunction with the accompanying drawings, in which:

DETAILED DESCRIPTION OF PREFERRED EMBODIMENT OF THE INVENTION

Figure 1:
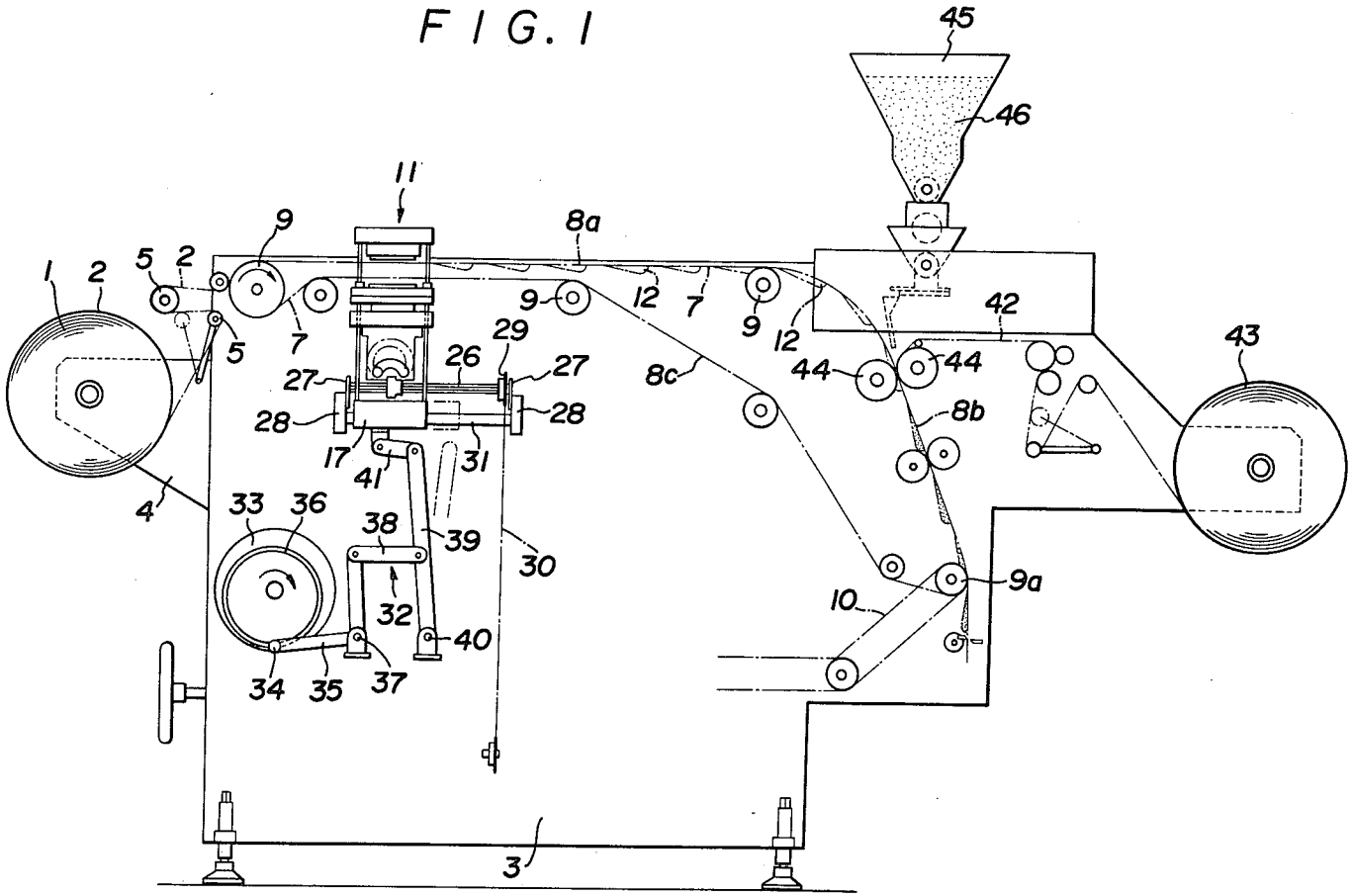
FIG. 1 is a schematic side view showing a packaging apparatus according to an embodiment of the present invention.

Referring to the packaging apparatus shown in FIG. 1, a roll 1 of a lower film 2 is rotatably supported on a machine frame 3 by a bracket 4, from which the lower film is drawn out through tension rollers 5. The both side edges of the lower film 2 are clamped by chucks 6 connected to an endless chain 7. The structure of the chuck 6 will be described hereinafter in detail. The endless chain 7 is arranged to travel along a substantially horizontal first passage part 8*a* at the upper end of the machine frame, a downwardly curved second passage part 8*b*, and a returning third passage part 8*c*. Such travelling of the endless chain 7 is guided by several sprockets 9—9, at least, one of the sprockets 9*a* operatively connected to a driving motor (not shown) by another connecting chain 10.

Figure 2:
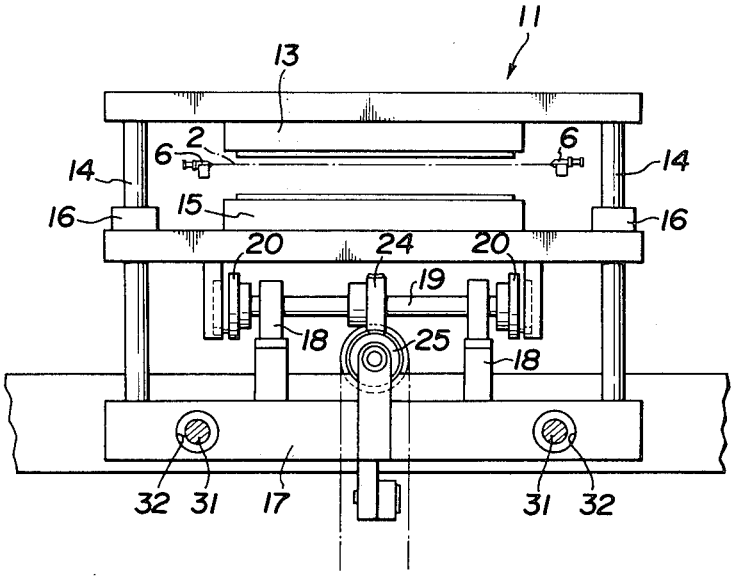
FIG. 2 is a fragmentary front view showing a molding device used in the apparatus of the present invention.
Figure 3:
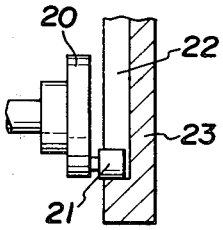
FIG. 3 is also a fragmentary view showing a cam assembly of the molding device in FIG. 2.

In the present apparatus, a molding device 11 is provided to form recesses 12 in the lower film while the latter is travelling along the horizontal first passage part 8*a* of the endless chain 7. In the molding device 11 shown in FIGS. 1 to 3, an upper mold 13 is provided above the lower film 2 and fixed to the upper ends of four vertical guide rods 14. A lower guide 15 is provided below the lower film 2 and slidably mounted upon the guide rods 14 by means of slides 16. The lower ends of the guide rods 14 are secured on a base plate 17. The base plate 17 has a pair of vertical supporting arms 18 extending upwardly therefrom through which a horizontal rotary shaft 19 is supported. The rotary shaft 19 has integral rotary discs 20 at both ends thereof to which cam followers 21 are rotatably connected, as shown in FIG. 3. These cam followers 21 are slidably engaged with the cam grooves 22 formed in vertical cam members 23 fixed to the lower mold 15 and downwardly extending therefrom. The cam grooves 22 are formed such that when the rotary shaft 19 as well as the cam followers 21 connected thereto are rotated, the lower mold 15 is moved up and down along the guide rods 14.

The rotary shaft 19 has a spiral gear 24 secured to the center part thereof which is engaged with a spiral slide gear 25 slidably mounted on a splined shaft 26. The splined shaft 26 extends horizontally in the film advancing direction and is supported at both ends thereof by bearing members 27. These bearing members 27 are connected to respective blocks 28 which are secured to the machine frame 3. The splined shaft 26 has a sprocket wheel 29 connected at one end portion thereof which is driven by a motor (not shown) by means of a chain 30. Extended between the blocks 28 are horizontal guide rods 31 which passes through holes 32 formed in the base plate 17 to allow the latter to slide along the guide rods 31.

The base plate 17 is caused to reciprocate along the guide rods 31 by a link and lever assembly 32 connected to a grooved rotary cam 33. That is, a cam follower 34 at one end of a L-shaped lever 35 is engaged with a groove 36 of the rotary cam 33, so that the lever 35 swings about a pivot 37 thereof when the rotary cam 33 is rotated. The other end of the L-shaped lever 35 is connected with a link 38 which, in turn, is connected with another lever 39 pivoted at the lower end 40 thereof to the machine frame 3, so that the lever 39 can swing about the pivot 40 thereof. The upper end of the lever 39 is also connected with a small link 41 whicn in turn is connected to the base plate 17. Thus, by the rotation of the rotary cam 33, the base plate 17 can reciprocate along the horizontal guide rod. The rotary cam 33 and also the link and lever assembly 32 are constructed in such a manner that the base plate 17 as well as the upper and lower molds 13 and 15 advance in synchronization with the advancement of the lower film 2. Further, it is arranged that when the base plate 17 advances, the lower mold 15 is raised toward the upper mold to close both molds so as to form recesses in the lower film, and when it returns from the most advanced position to the left hand side in FIG. 1, the lower mold is separated from the upper mold. The upper and lower molds 13 and 15 have heaters and vacuum means (not shown) therein to form a plurality of recesses 12 in the lower film during the advancement thereof. Preferably, each recess 12 formed in the lower film 3 has a rectangular shape in plan view and a wedge shape in sectional side view which has a depth becoming deeper in the advancing direction of the lower film.

Figure 4:
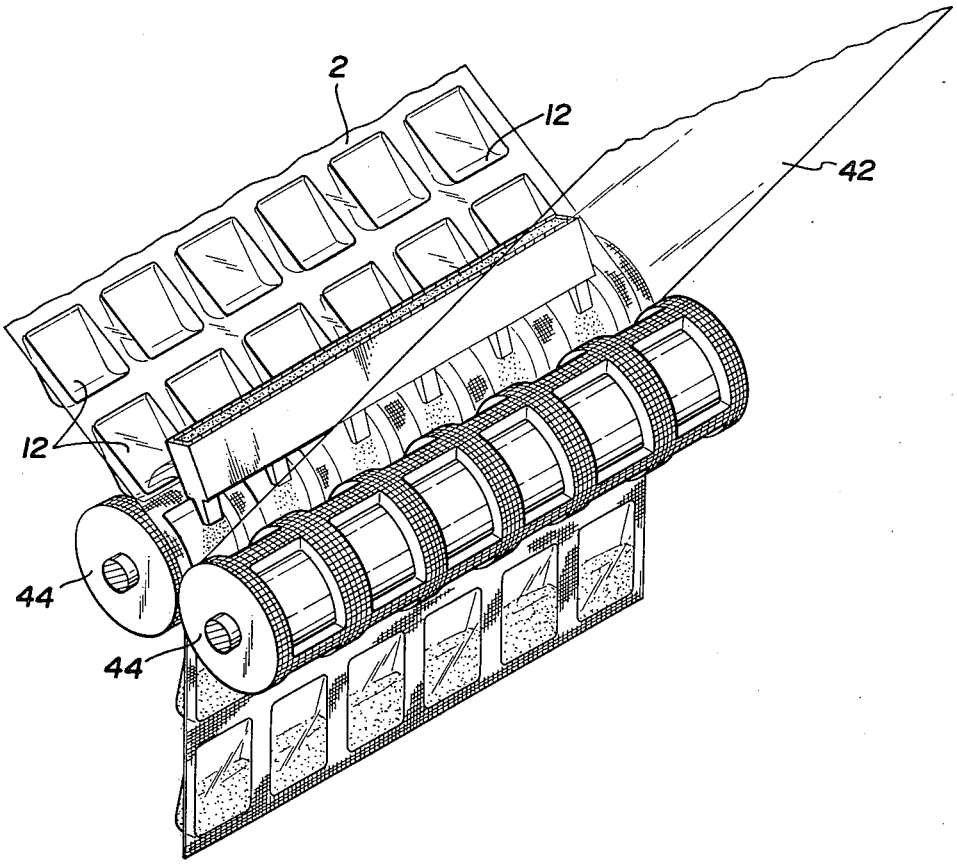
FIG. 4 is a perspective view showing the process of feeding powdery material into recessed pockets between upper and lower films and sealing them, FIGS. 5(*a*) and 5(*b*) are views showing a conventional chuck connected to a chain, wherein FIG. 5(*a*) is a partially sectioned enlarged front view and FIG. 5(*b*) is a side view, and FIGS. 6(*a*) to 6(*c*) are views showing an improved chuck structure connected to a chain applied to the present apparatus, wherein FIG. 6(*a*) is an enlarged front view, 6(*b*) is an enlarged side view, and 6(*c*) is another side view.

The lower film 2 having the recesses 12 formed therein is further advanced to the downwardly curved second passage part 8*b*, where powdery or small particle-size material is packaged. In the second passage part 8*b*, an upper film 42 is supplied continuously from a roll 43 thereof in such a manner that the upper and lower films approach together in the shape of "V" by means of a pair of sealing rollers 44. Provided above the sealing rollers 44 is a hopper 45 containing powdery material 46, for example, therein, from which a predetermined amount of the powdery material is fed into the recesses 12 between the upper and lower films 2 and 42, respectively. As is best shown in FIG. 4, when the two films are pinched by the sealing rollers 44, the upper film is sealingly adheres to the outer peripheries of the recesses in the lower film 2. At the time when the lower part of the recesses 12 are covered and sealed by the upper film to form recessed pockets between the upper and lower films, the powdery material is fed into the pockets. Then, by the further downward advancement of the films through the rollers 44, the outer peripheries of the recesses are completely sealed by the upper film with the powdery material in the recesses between the upper and lower films.

The thus sealed packages 46 are further advanced downwardly through a pair of slitter rollers 47, which which longitudinal slits 48 are partially formed between laterally adjacent packages to make it easy to separate them from the laterally adjacent ones. Finally, these packages are led to a rotary cutter 49, by which the sealed portion between the longitudinally adjacent packages are laterally cut to provide laterally connected packages with slits therebetween.

Figure 5A:
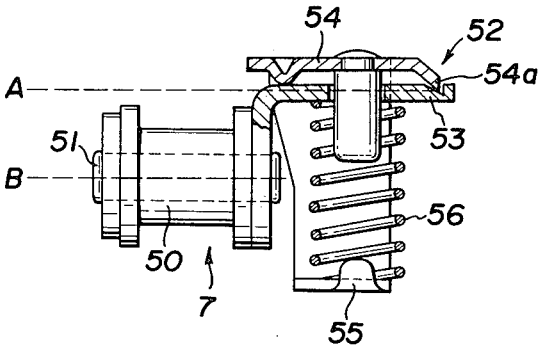
Figure 5B:
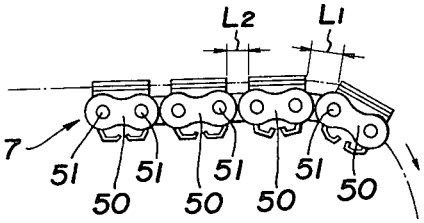

Reference is now made hereinafter to an improved chuck structure mounted on the endless chain of the present apparatus for clamping the side edges of the lower films and carrying the same. Referring first to a conventional chuck structure shown in FIGS. 5(*a*) and 5(*b*), the endless chain 7 comprises a number of chain units 50 connected with each other by roller pins 51. Each chain unit 50 has a chuck 52 connected to one side thereof. The chuck 52 comprises a fixed pawl 53 fixed to the side surface of the chain unit 50 and a movable pawl 54 mounted upon the fixed pawl 53. The movable pawl 54 has a pair of downwardly and then inwardly curved arms 55—55 and a coil spring 56 interposed between the fixed pawl 53 and the ends of the arms 55. Thus, the movable pawl 54 is normally pressed upon the fixed pawl 53 and clamps the film at the clamping end 54*a* thereof. However, when the arms 55 of the movable pawl 54 are pressed upwardly against the coil spring 56 in FIG. 5(*a*), for example, by contacting a guide member during the advancement of the chain, the clamping end 54*a* of the movable pawl is separated from the fixed pawl, thereby releasing the engagement with the film.

In such a conventional chuck structure as set forth above, the clamping level "A" on which the clamping end 54*a* of the movable pawl is located is different from or higher than the pin level "B" on which the center line connecting the roller pins 51 is located. Accordingly, when the endless chain advances from the horizontal passage to the downwardly curved passage, the gap "$L_1$" between the adjacent chucks 52 becomes wider than the gap "$L_2$" between the chucks on the horizontal passage. This widening of the gap "$L_1$"

causes partial extension of the clamped film, whereby the packages formed by such partially extended film will have wrinkles therein which spoil the external appearances thereof.

In order to overcome the disadvantage of the conventional chuck structure set forth above, the chuck 52 of the present invention is arranged such that the clamping lever "A" is substantially on the same level as the pin level "B", so that the clamping end 54*a* of the movable pawl 5 is on the same level as the center line connecting the roller pins 51. Thus, at any travelling position of the endless chain, the gap between the adjacent chucks 52 is constant. There is no chance that the clamped film will be extended at any travelling position of the endless chain.

Figure 6B:
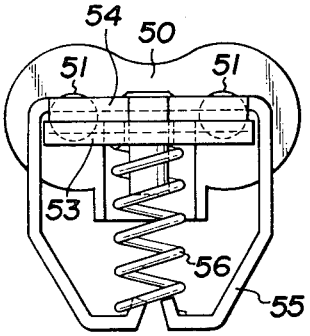
Figure 6A:
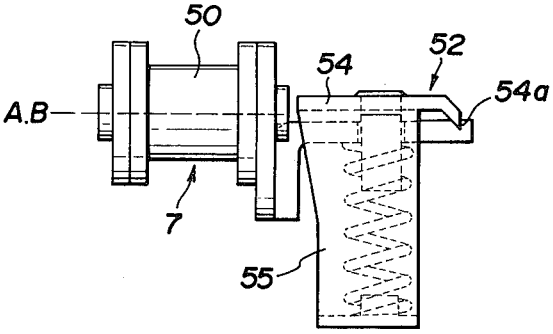
Figure 6C:
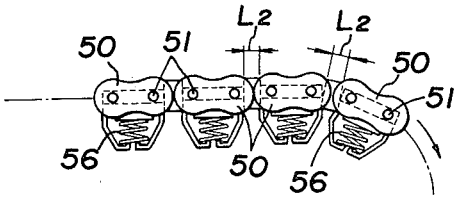

As can be understood from the disclosure set forth above, the package of the powdery or particle-size material of the present invention can be formed continuously without stopping the advancement of the upper and lower films. Also, since the recesses 12 are formed in the lower film 2 while it is travelling along the first passage part 8*a*, it is very easy to feed the powdery or particle-size material into the recessed pockets at the downwardly curved second passage part when the recesses in the lower film are partially covered with the upper film. Another advantage of the present invention is that since the recess is formed in the lower film, the present package containing the powdery material or particle-size material can be much smaller than the known package in which the powdery material has been contained between two flat films. Thus, the present invention can save greatly on the material costs as well as the custody charge and transportation fee. Furthermore, the present packaging apparatus using the improved chuck structure set forth with reference to FIGS. 6(*a*)–6(*c*) will not form wrinkles or waves on the packages, which will spoil external appearence of the packages.

Although the present invention has been described with reference to a preferred embodiment thereof, many modifications and alterations may be made within the spirit of the present invention.

What is claimed is:

1. An apparatus for packaging powdery or particle-size material comprising means for continuously carrying a lower film with chucks clamping the two side edges of said lower film, said chucks being connected to endless chains which travel continuously along a substantially horizontal first passage part, a downwardly curved second passage part, and a returning third passage part, means for molding a plurality of recesses in said lower film, said molding means being movable in synchronization with the advancement of said lower film during which said recesses are formed in said lower film, means for continuously carrying an upper film against said lower film, said upper film and lower film approaching together in the shape of "V" in section at said second passage part and then being sealed together as they move down further along said second passage part, means for feeding powdery or particle-size material into said recesses between said lower film and said upper film while the lower parts of said recesses are partially covered with said upper film, and means for cutting the sealed upper and lower films with the powdery or particle-size material therebetween.

2. An apparatus as claimed in claim 1, wherein said molding means comprises a pair of upper and lower molds connected with each other such that one of said molds is moved toward and away from the other mold, a base plate member upon which said upper and lower molds are mounted, said base plate member being reciprocable along said first passage part with an advancing speed equal to that of said lower film, and means for pressing one of said molds toward the other mold while said base plate member is advanced to form a plurality of said recesses in said lower film and for separating one of said molds from the other mold while said base plate is returned from the advanced position.

3. An apparatus as claimed in claim 1, wherein each endless chain comprises a number of chain units connected with each other by roller pins, each chain unit having a chuck connected thereto with a clamping end thereof on the same level as the center line connecting said roller pins of said chain unit.

4. An apparatus as claimed in claim 1, wherein said molding means forms a plurality of wedge-shaped recesses in said lower film in sectional side view, each recess having a depth which becomes deeper in the advancing direction of said lower film.

5. An apparatus as claimed in claim 2, wherein said base plate member has vertical guide poles upon which said lower mold is slidably provided to move toward and away from said upper mold which is secured to the upper ends of said guide poles, said base plate member being caused to slide and reciprocated along horizontal guide rods, and said means for pressing said lower mold toward said upper mold comprises a rotary shaft which is rotated during reciprocal movement of said base plate member and a cam assembly provided between said rotary shaft and said lower mold.

6. A method for continuously packaging powdery or particle-size material comprising the steps of supplying a continuous lower film in the horizontal direction, pressing a pair of upper and lower molds against each other with said lower film interposing therebetween, moving said upper and lower molds in synchronization with the movement of said lower film while said upper and lower molds are pressed against each other, thereby forming a plurality of recesses in said lower film, advancing said lower film along a downwardly curved passage, supplying a continuous upper film such that said upper film approaches said lower film in the shape of "V" at said curved passage, feeding powdery or particle-size material into said recesses between said upper and lower films after each of said recesses is partially covered and sealed with said upper film by means of a pair of sealing rollers, completely sealing said recesses by said upper film through said sealing rollers with the powdery or particle-size material therebetween, and cutting the thus sealed upper and lower films into a predetermined number of packages.

* * * * *